United States Patent [19]

Brumlik

[11] 3,986,331

[45] Oct. 19, 1976

[54] NET-LIKE COMPOSITE FILAMENTS

[75] Inventor: George C. Brumlik, Montclair, N.J.

[73] Assignee: Ingrip Fasteners Inc., Montclair, N.J.

[22] Filed: Mar. 24, 1975

[21] Appl. No.: 561,590

Related U.S. Application Data

[63] Continuation-in-part of Ser. No. 322,252, Jan. 9, 1973, abandoned.

[52] U.S. Cl. ..... 57/140 R; 57/140 BY; 57/144; 57/153; 428/222; 428/224; 428/371; 428/378; 428/398

[51] Int. Cl.[2] ..... D02G 3/22; D02G 3/40

[58] Field of Search ..... 57/140 C, 140 R, 34 HS, 57/140 BY, 157 TS, 144, 153; 28/76 T; 428/369, 222, 370, 371, 378, 376, 398, 399; 156/167, 173, 181

[56] References Cited

UNITED STATES PATENTS

| | | | |
|---|---|---|---|
| 2,815,559 | 12/1957 | Robinson | 57/34 HS X |
| 3,019,507 | 2/1962 | Maragliano et al. | 57/140 R X |
| 3,025,661 | 3/1962 | Strub, Jr. et al. | 57/157 TS |
| 3,399,521 | 9/1968 | Thoma et al. | 28/76 T X |
| 3,449,199 | 6/1969 | Mead | 428/222 X |
| 3,474,703 | 10/1969 | Davis et al. | 57/153 X |
| 3,687,759 | 8/1972 | Werner et al. | 156/167 |
| 3,691,004 | 9/1972 | Werner et al. | 428/378 X |

*Primary Examiner*—John Petrakes
*Attorney, Agent, or Firm*—Burgess, Dinklage & Sprung

[57] ABSTRACT

Open structured, net-like composite filaments are disclosed and include two or more longitudinally extending wavy or undulating filaments which intersect one another at a plurality of points. The wavy or undulating filaments are joined to one another at least at a portion, preferably a majority or all, of their intersecting points to maintain the configuration of the individual filaments and to sustain the open structure of the composite filaments.

8 Claims, 17 Drawing Figures

NET-LIKE COMPOSITE FILAMENTS

RELATED APPLICATIONS

This application is a continuation-in-part of copending application Ser. No. 322,252, filed Jan. 9, 1973, now abandoned.

BACKGROUND

This invention relates to open structure, net-like composite filaments and in particular to composite filaments comprising intersecting wavy filaments having a rotational component, e.g., spiral or helical, and joined to one another at a majority of their intersecting points.

Commercially available fibers, filaments and yarns are made of natural and synthetic materials which are generally solid in cross-section. In the past these materials have been designed for long wear in garment construction and for scuff and abrasion resistance in carpets and other floor coverings. Present day architectural and design practices often call for interior and exterior surface coverings, other than for floors or decks made of woven, non-woven or flocked fibrous materials. Such surface coverings require inexpensive fibers and filaments and are characterized by exceptionally high bulk/weight factors combined with excellent thermal, sound and electrical insulating properties. The use of conventional fibers and filaments in these applications is expensive, however, because of the unfavorable bulk/weight factors.

The present invention provides composite filaments which are characterized by an open, net-like structure, which greatly increases their space-filling bulk per unit weight and provides inexpensive and material saving filaments. The open structure of the composite filaments of the invention greatly improve thermal, electrical and sould insulating properties and can be used in the fabrication of non-woven, woven, knitted, and flocked materials and articles in much the same way as solid fibers and filaments. The composite filaments of the invention provide an excellent appearance at greatly reduced cost from a materials standpoint and greatly reduced weight per unit area.

SUMMARY

The present invention provides open structured, net-like composite filaments comprising at least two longitudinal extending helical filaments which twist about a common axis and intersect one another at a plurality of points to define a generally cylindrical shape with a hollow core, the helical filaments twisting about the circumference thereof. The helical filaments are joined to one another at least at a portion of their intersecting points sufficient to maintain the configuration of the individual filaments and to sustain the open structure of the composite filaments. The individual filaments are preferably joined at a majority or all of their points of intersection.

The composite filaments of the invention by virtue of their open structure make possible greatly reduced weight per unit area and consequently lower cost from a material standpoint. The composite filaments, however, do not sacrifice appearance and can be used to form woven, non-woven and knitted materials and articles, yarns, tufted materials, carpet materials and flocked articles using conventional fabricating techniques.

DESCRIPTION OF THE DRAWING

FIGS. 5*a* through 5*e* are top plan views illustrating several spiral relationships that can exist between two or more intersecting helical or spiral filaments.

DESCRIPTION

Figure 1:
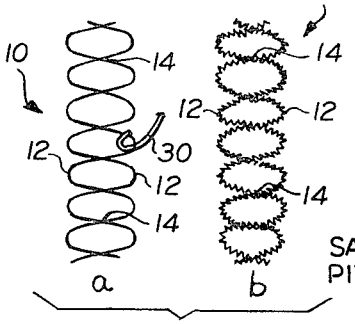
FIG. 1*a* and *b* are side elevational views showing pairs of wavy filaments intersecting one another to form the composite filaments of the invention.

Referring now to the drawing and in particular FIGS. 1–4, the composite filament 10 of the invention is shown to include two or more wavy filaments 12 intersecting one another at a plurality of points 14. The filaments 12 are joined to one another at portion of the intersecting points 14 sufficient to maintain the configuration of the individual filaments 12 and to maintain and sustain the open structure of the composite filaments 10 itself. It is preferred that the individual filaments 12 be joined at a majority or more preferably all of their intersecting points 14 to maximize and take full advantage of the structural cooperation between the intersecting filaments 12.

FIGS. 1*a* and 1*b* illustrate that the individual filaments 12 can be themselves smooth or textured such as by crimping as illustrated in FIG. 1*b*. The individual filaments 12 themselves can also be twisted, curved, coiled, spiraled, kinked, cellular, porous or otherwise uniformly or randomly textured.

The term wavy, as applied to the configuration of the individual filaments within the composite filaments of the invention, is intended to describe random or uniform wavy configurations. Thus, the individual filaments 12 can be undulatory, billowy, serpentine, torturous, and the like within the context of a wavy configuration.

Figures 2, 3, 4, 5:
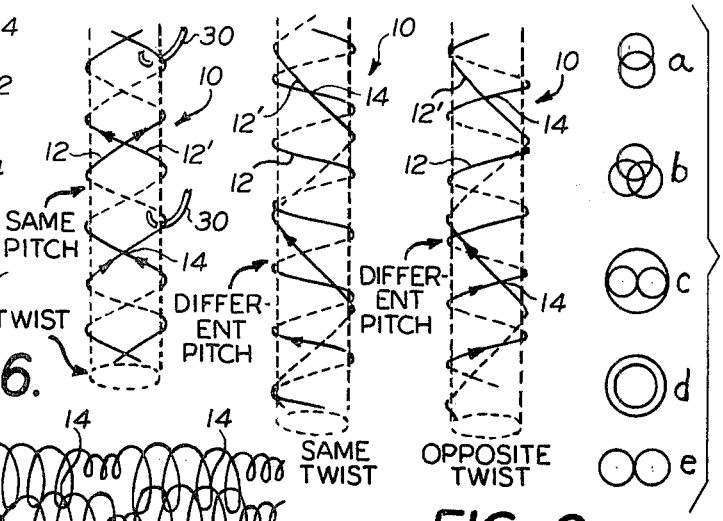
FIGS. 2, 3 and 4 are side elevational views illustrating pairs of helical filaments intersecting each other with variations in the direction of rotation and pitch to form composite filaments of the invention.

FIGS. 2 through 4 illustrate preferred embodiments wherein the individual filaments 12 and 12′ also have a rotational component which can be generally described as helical. Other configurations within the context of the general term helical include spiral, coil, twirl, whorl, curl, curlicue, and volute.

FIGS. 5*a* through *e* diagrammatically illustrate several ways in which helical filaments 12 can intersect to form the composite filament of the invention. For example, the helical filaments can intermesh (FIGS. 5*a* and *b*) or they can be coaxial (FIGS. 5*c* and *d*) or they can be tangential (FIG. 5*e*). FIG. 5*b* also illustrates that more than two helical filaments can intermesh to form a composite filament of the invention.

Composite filaments of the invention made of helical filaments can have a predetermined structure or can be completely random, or can be partly uniform and partly random by controlling the "handiness" (direction of rotation), the pitch, radius, and/or period of rotation of the helical filaments with respect to each other. For example, in FIG. 2 the helical filaments 12 at the same pitch and twist at opposite directions from each other, that is one is right-handed and the other is left-handed. In FIG. 3 the two helical filaments 12 both rotate in the same direction but differ in pitch of rotation with respect to each other. FIG. 4 shows a similar configuration wherein the two helical filaments rotate in opposite directions.

Figure 6:
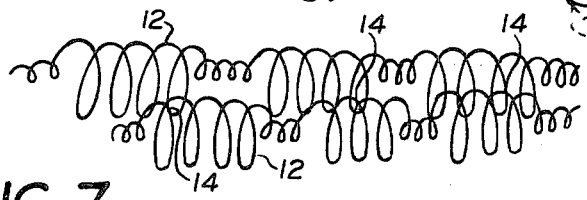
FIG. 6 is a side elevational view of a composite filament of the invention formed from intersecting helical filaments each of which varies with respect to its period of rotation.

FIG. 6 illustrates the complexity of structure of the composite filaments that can be programmed or predetermined for the individual helical filaments. In this illustration the helical filaments 12 each vary with respect to their individual periods of rotation and intersect out of phase with respect to each other.

Figure 7:
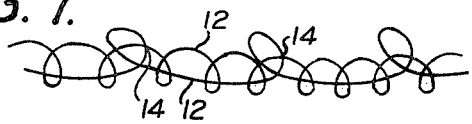
FIG. 7 is a side elevational view showing a composite filament of the invention formed from intersecting helical filaments which have been flattened into a ribbon-like shape.
Figure 8:
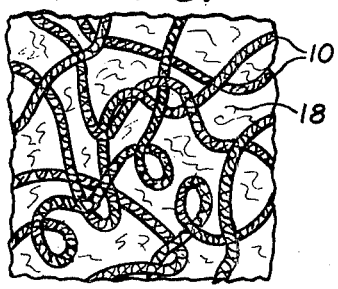
FIGS. 8 and 9 are diagrammatic views illustrating various ways in which a composite filament of the invention can be utilized as a component of non-woven and woven materials.

FIG. 7 illustrates a composite filament made of intermeshing and intersecting helical filaments which has been flattened into a ribbon-like structure. FIGS. 8 through 12 illustrate only a few ways in which the composite filaments of the invention can be beneficially utilized. In FIG. 8 composite filaments 10 are incorporated into a non-woven structure which also includes conventional filaments 18, it being understood that any material or article can be formed wholly of the composite filaments of the invention or can also include conventional filaments and fibers as well.

Figure 9:
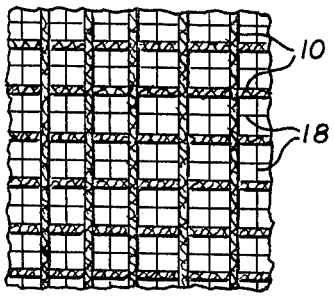
Figure 10:
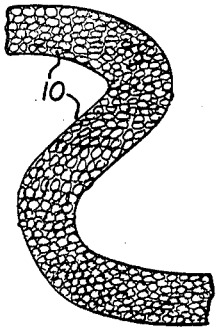
FIG. 10 is a side elevational view illustrating a yarn spun or twisted from composite filaments of the invention.
Figure 12:
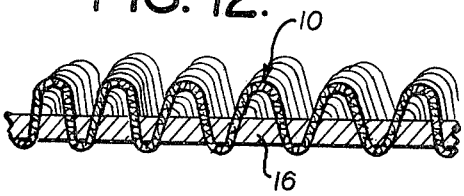
FIG. 12 is a side elevational partly in perspective showing a carpet-like material or article incorporating the composite filaments of the invention.

FIG. 9 illustrates a woven material comprising composite filaments 10 with conventional filaments interspersed therein. FIG. 10 shows a spun or twisted yarn made of composite filaments of the invention and FIG. 12 illustrates a carpet-like structure wherein the composite filaments 10 are woven or tufted into a base 16 using conventional carpet manufacturing techniques.

Figure 11:
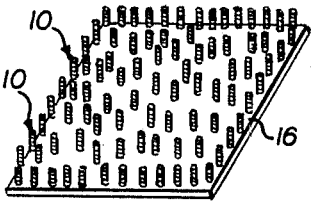
FIG. 11 is a perspective view of a multi-element structure including pile elements formed from the composite filaments of the invention flocked or otherwise attached, in an upright, pile-like fashion to a base.

The composite filaments of the invention can also be cut into staple fibers or pile elements which can be incorporated into non-woven materials such as felted or flocked sheet materials. In addition, pile elements can be flocked or otherwise attached onto a base in an upright fashion to form a multi-element or pile-like structure as illustrated in FIG. 11.

Because the composite filaments of the invention have an open net-like structure they offer a vast number of sites for entering into self-gripping engagement with a gripping element such as the hook members 30 diagramatically illustrated in FIGS. 1*a* and 2. Thus, any of the materials illustrated in FIGS. 8, 9, 11 and 12 are excellent receiving materials for multi-element self-gripping devices.

In addition, to forming all or part of a yarn or a woven, non-woven, or knitted structure, the composite filaments of the invention or staple fibers or piles cut therefrom can be used in felts, filters, packaging and insulating materials, porous and foamed plastics and as a reinforcing material for plastics both foamed and unfoamed and the like, resulting in greatly increased properties in tension and impact.

Figure 13:
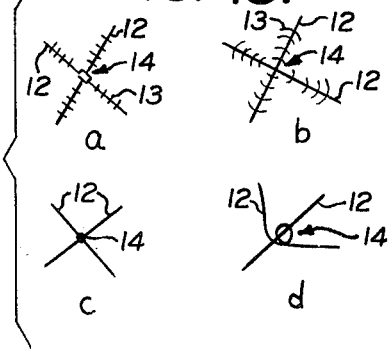
FIGS. 13*a* through 13*d* are plane views illustrating several ways in which intersecting filaments can be joined to each other in the composite filaments of the invention.

Referring now to FIG. 13, the individual filaments 12 can be joined to each other at their points of intersection by mechanical or adhesive means or by sealing or fusing. In FIGS. 13*a* and *b* for example, the individual filaments 12 can be provided with branches, scales, hooks or barbs, indicated generally by the reference numeral 13 which can mechanically interlock at the point of intersection 14.

FIG. 13*d* illustrates that one filament 12 can twist about another filament 12 at the point of intersection 12 to become joined together. FIG. 13*c* illustrates the adhesive bonding of two filaments 12 at intersecting point 14. Suitable adhesives include hot melt and solvent activated adhesives catalyzed polymer adhesives which harden at room or elevated temperatures, or hardening adhesives and the like.

Individual filaments forming the composite filament of the invention can be made of natural materials such as wool, cotton, linen, and the like, or synthetic materials such as nylons, polyesters, rayon, polyamides, polyacrylates, polyolefins such as polyethylene and polypropylene, and the like. The composite filaments can be formed using conventional spinning or twisting devices. The intersecting filaments can be simultaneously or subsequently joined together, for example, by spraying or immersing in an adhesive or by exposing the formed composite filament to hot fluids or gases, radiant heat, and the like, to cause the filaments to seal or fuse at their points of intersection. It is also within the scope of the invention to post-treat the composite filaments mechanically or chemically to alter their physical or chemical properties. For example, the composite filaments can be longitudinally stretched to orient the individual filaments or they can be heat treated to cause cross-linking of the polymer and the like.

In FIGS. 2–4, the helical filaments have opposite or the same twists as shown. These figures also show in phantom the general cylindrical configuration the cotwisted helical filaments described. The phantom lines do not indicate structure, only the general physical configuration defined by the cotwisted filaments 12 and 12'.

Composite filaments as shown in FIGS. 2–4 can be made by twisting two or more filaments in space and then bonding using adhesives, spin bonding and/or fusion via exposure to adhesives, heat or solvents. The filaments 12 and 12' can also be twisted on a mandrel and removed to form the hollow cylindrical shape.

What is claimed is:

1. Composite filament having an open-net-like structure comprising at least two longitudinally extending helical filaments twisting about a common axis and intersecting one another at a plurality of points thereby defining a generally cylindrical shape with a hollow core with the helical filaments twisting about the circumference thereof, said helical filaments being joined to one another at least at a portion of said intersecting points sufficient to maintain the helical configuration of said filaments and the open structure of said composite filament.

2. Composite filaments of claim 1 wherein said helical filaments intersect one another tangentially.

3. Composite filaments of claim 2 wherein said helical filaments twist in opposite directions.

4. Composite filaments of claim 1 wherein said helical filaments twist in the same direction and differ in pitch with respect to each other.

5. Composite filaments of claim 1 wherein the helical filaments differ in pitch and twist in opposite directions.

6. A woven material comprising the composite filaments of claim 1.

7. A yarn comprising the composite filaments of claim 1.

8. A non-woven material comprising the composite filaments of claim 1.

* * * * *